US008550321B2

(12) United States Patent
Webb

(10) Patent No.: US 8,550,321 B2
(45) Date of Patent: Oct. 8, 2013

(54) TOOL FOR DRIVING FASTENERS

(75) Inventor: Roger Clyde Webb, George Town (AU)

(73) Assignee: Poly Systems Pty Ltd (AU)

( * ) Notice: Subject to any disclaimer, the term of this patent is extended or adjusted under 35 U.S.C. 154(b) by 392 days.

(21) Appl. No.: 12/993,550

(22) PCT Filed: May 20, 2009

(86) PCT No.: PCT/AU2009/000629

§ 371 (c)(1),
(2), (4) Date: Nov. 19, 2010

(87) PCT Pub. No.: WO2009/140728

PCT Pub. Date: Nov. 26, 2009

(65) Prior Publication Data

US 2011/0068142 A1 Mar. 24, 2011

(30) Foreign Application Priority Data

May 21, 2008 (AU) ..... 2008902501
Jul. 23, 2008 (AU) ..... 2008903770

(51) Int. Cl.
*B25D 9/10* (2006.01)

(52) U.S. Cl.
USPC ..... 227/10; 123/46 SC

(58) Field of Classification Search
USPC ..... 227/9–11; 123/46 SC, 592
See application file for complete search history.

(56) References Cited

U.S. PATENT DOCUMENTS 4,483,280 A * 11/1984 Nikolich ..... 123/46 SC
5,213,247 A * 5/1993 Gschwend et al. ..... 227/10
6,938,811 B2 * 9/2005 Ehmig et al. ..... 227/10
8,091,751 B2 * 1/2012 Tanaka ..... 227/10
8,113,403 B2 * 2/2012 Tanaka et al. ..... 227/10
2008/0314952 A1 * 12/2008 Tamura et al. ..... 227/10

FOREIGN PATENT DOCUMENTS

EP 0056989 8/1982
WO WO2005/110684 11/2005
WO WO2007/099819 9/2007

OTHER PUBLICATIONS

International Search Report from related PCT/AU2009/000629.

* cited by examiner

*Primary Examiner* — Alexandra Elve
*Assistant Examiner* — Andrew M Tecco
(74) *Attorney, Agent, or Firm* — Winthrop & Weinstine, P.A.

(57) ABSTRACT

A hand-held power tool powered by a gas combustion mechanism comprising a first combustion chamber, a second chamber within a driving cylinder having aft and fore ends. The first combustion chamber in fluid communication with the second chamber via the aft end, a fan assembly, a driver assembly having a piston and driver movable therewithin between the aft and fore end, and a drive motor operably connected to the driver assembly. In use, whilst the piston is at or near the fore end of the driving cylinder, the fan assembly introduces air into the chambers thereby at least partially pressuring the air there within, fuel gas is introduced into the combustion chamber to form an air/fuel gas mixture therein, the drive motor operably moves the piston to a position at or near the aft end thereby compressing the air/fuel gas mixture within the combustion chamber so that the air/fuel mixture is ignited to impart motion onto the and to facilitate the operation of the tool.

20 Claims, 11 Drawing Sheets

TOOL FOR DRIVING FASTENERS

TECHNICAL FIELD

The present invention relates to an internal combustion fastener driving tool.

BACKGROUND

Fastener driving tools, also known as impulse tools, have been developed that use internal combustion as a power source to drive fasteners such as nails into a work piece or substrate. The tools ignite a fuel/air mixture in a combustion chamber to forcibly drive a piston, which then ejects the fastener from the tool. The effectiveness of the prior art is largely limited to their efficiency in rapidly igniting the complete volume of fuel/air mixture. If insufficient volumes of fuel ignite, the device delivers unsuitable driving forces to the fastener. If the tool produces unreliable power outputs the fasteners may be driven to unsatisfactory depths or insufficiently seated. Prior art devices have attempted to address these inefficiencies by making a larger tool and wasting larger volumes of fuel.

Some prior art tools also suffer from what is known as misfire or non-fire. This occurs when the tool is operated in low temperature conditions or at high altitude and hot conditions. The cause of the phenomenon is; (a) insufficient atomization and mixing of the air/fuel; (b) an insufficient fuel/air ratio; (c) low air density.

One such prior art tool is described in U.S. Pat. No. 5,213,247 (Gschwend et al). This device includes a network of mechanisms that operate to measure a specific quantity of fuel and then draw that fuel, along with air, into a combustion chamber by mechanically expanding the combustion chamber volume. A drawback of this device is that the fuel and gas are not mixed sufficiently, which decreases the efficiency of combustion.

A further disadvantage of such prior art tools is the tool mass (weight and physical size) required for a given output of energy. Furthermore, such tools draw fuel and air into the combustion chamber with partial vacuum. As a consequence the fuel/air mixture is ignited at a low pressure, which leads to a low burn rate and further inefficiency. This is particularly problematic in that the less efficient an internal combustion fastener driving tool is, the more susceptible the device is to output fluctuations that result in ignition failures and unsatisfactory driving forces to the fastener.

Also prior art impulse tools such as those used in nail and fixing in the building industry have limitations in their use. Such tools have the capability of producing 70 to 100 joules of output energy. These tools will only produce their manufactured claimed output under optimal conditions ie; 24C @ sea level and a relevant humidity level of approximately 40%. If these optimum conditions change, so does the power output by as much as 25%, and in some cases they do not fire at all. This means that nails and fixers sometimes protrude and are only driven 80 to 90% of the manufactured depth, and thus the work piece may not meet building standards. This may also lead the operator to have to use a traditional hammer to finish the job.

Some impulse tool manufactures have developed tools to produce in excess of 100 joules, but such tools have ended up being a far larger unit for consumers to reasonably expect to purchase.

All prior art combustion tools used for fixing, suffer from gumming up and need to be cleaned regularly. This is caused by incomplete combustion in the tool. Carbon, lubricants and other bi-products of combustion and exhaust gases build up deposits within the combustion chamber, driver piston and head.

The present invention seeks to provide a fastener driving tool that will ameliorate or overcome at least one of the deficiencies of the prior art.

SUMMARY OF INVENTION

According to a first aspect the present invention consists in a hand-held power tool, the operational power of which is provided by a gas combustion mechanism, said gas combustion mechanism comprising a first combustion chamber, a second chamber within a driving cylinder having an aft end and a fore end, said first combustion chamber in fluid communication with said second chamber via said aft end, at least one fan assembly, a driver assembly having a piston and driver movable within said driving cylinder between said aft end and said fore end, and a drive motor operably connected to said driver assembly, wherein in use, whilst said piston is at or near said fore end of said driving cylinder, said fan assembly introduces air into said first combustion chamber and said second chamber thereby at least partially pressuring the air there within, fuel gas is introduced into said combustion chamber from a fuel supply port, the air and fuel gas being mixed to form an air/fuel gas mixture therein, said drive motor operably moves said piston to a position at or near said aft end thereby compressing said air/fuel gas mixture within said first combustion chamber so that said air/fuel mixture is ignited within the combustion chamber to impart motion onto said piston and to facilitate the operation of the tool.

Preferably said fan assembly has a first external induction fan for introducing air into said first combustion chamber.

Preferably said fan assembly has a second internal circulation fan disposed within said first combustion chamber.

Preferably said second internal circulation fan is shrouded by a shroud having a free end portion that is frusto-conical in shape.

Preferably said first combustion chamber is frusto-conically shaped in a region near where it adjoins said driving cylinder.

Preferably said piston has an aft surface having a concave toroidal shape therein for redirecting air centrally forced thereon by said fan assembly.

Preferably a separate exhaust cavity is at least partially disposed externally around said first combustion chamber and said driving cylinder, said exhaust cavity having an exhaust vent located near the fore end of said driving cylinder.

Preferably a plurality of apertures interconnect said exhaust cavity with said first combustion chamber, and an air ducting shroud disposed near said apertures prevents air from passing there through when air is being introduced into said combustion chamber by said fan assembly.

Preferably at least one exhaust port in communication with said exhaust cavity is located in said driving cylinder near its aft end, said exhaust port being closed by said piston when same has travelled to said aft end of said driving cylinder.

Preferably said exhaust port closes prior to the air inlet side of said combustion chamber, thereby allowing supercharged air to be introduced into said combustion chamber.

Preferably said tool further comprises a movable tool nose assembly and a trigger assembly both operably connected to an ECM for the control and actuation of the fan assembly, drive motor and gas supply port.

Preferably said fan assembly and said drive motor are operably powered by a battery.

Preferably said drive motor is adapted to act as a generator operably connected to ECM for charging of said battery.

Preferably said air/fuel mixture is ignited by an ignition process initiated by multiple high tension sparks.

Preferably said multiple high tension sparks are emitted from a plurality of igniters.

Preferably in one embodiment the air is introduced into the combustion chamber and driver by a turbine/fan compressor.

Preferably the air is introduced into the combustion chamber and driver by a positive displacement rotary vane compressor.

Preferably the air introduced into the combustion chamber and driver is super-charged and a holding mechanism holds the driver assembly against super-charged air until ignition takes place.

Preferably the increase in tool output energy is a result of supercharging.

According to a second aspect the present invention consists in a hand-held power tool, operational power of which is provided by a gas combustion mechanism, said gas combustion mechanism comprising a first combustion chamber, and a second chamber within a driving cylinder having an aft end and a fore end, said first combustion chamber in fluid communication with said second chamber via said aft end, and a driver assembly having a piston and driver movable within said driving cylinder between said aft end and said fore end, and a drive motor operably connected to said driver assembly, wherein in use the volume of said first combustion chamber and said second chamber is fluidally pressurized in first and second stages, where said first stage comprises introducing supercharged air into said first combustion chamber and said second chamber via a fan whilst said piston is at or near said fore end of said driving cylinder and subsequently a fuel gas is introduced into said combustion chamber from a fuel supply port, the air and fuel gas being mixed to form an air/fuel gas mixture therein, and in said second stage said drive motor moves said piston to said aft end thereby compressing said fuel/gas mixture in said first combustion chamber so that said air/fuel mixture is ignited within the combustion chamber to impart motion onto said piston and to facilitate the operation of the tool.

DESCRIPTION OF PREFERRED EMBODIMENTS

Figure 1:
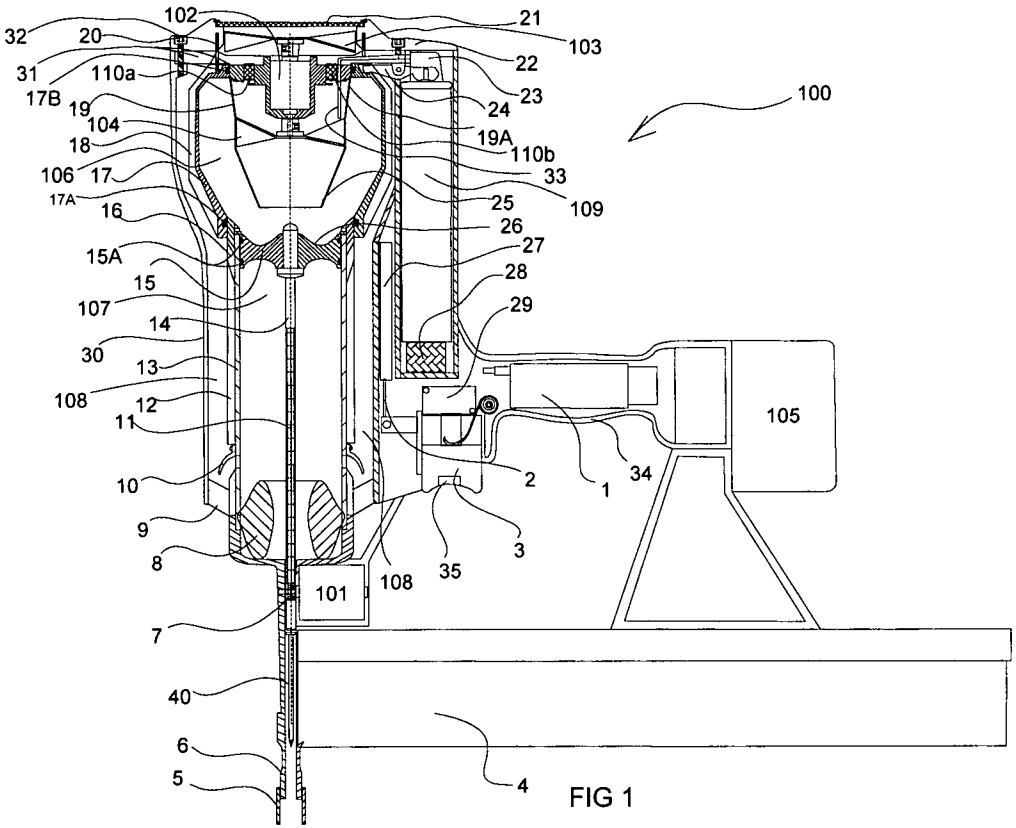
FIG. 1 shows a schematic cross-sectional view of a hand held internal combustion nail fastener tool in accordance with a first embodiment of the present invention.
Figure 2:
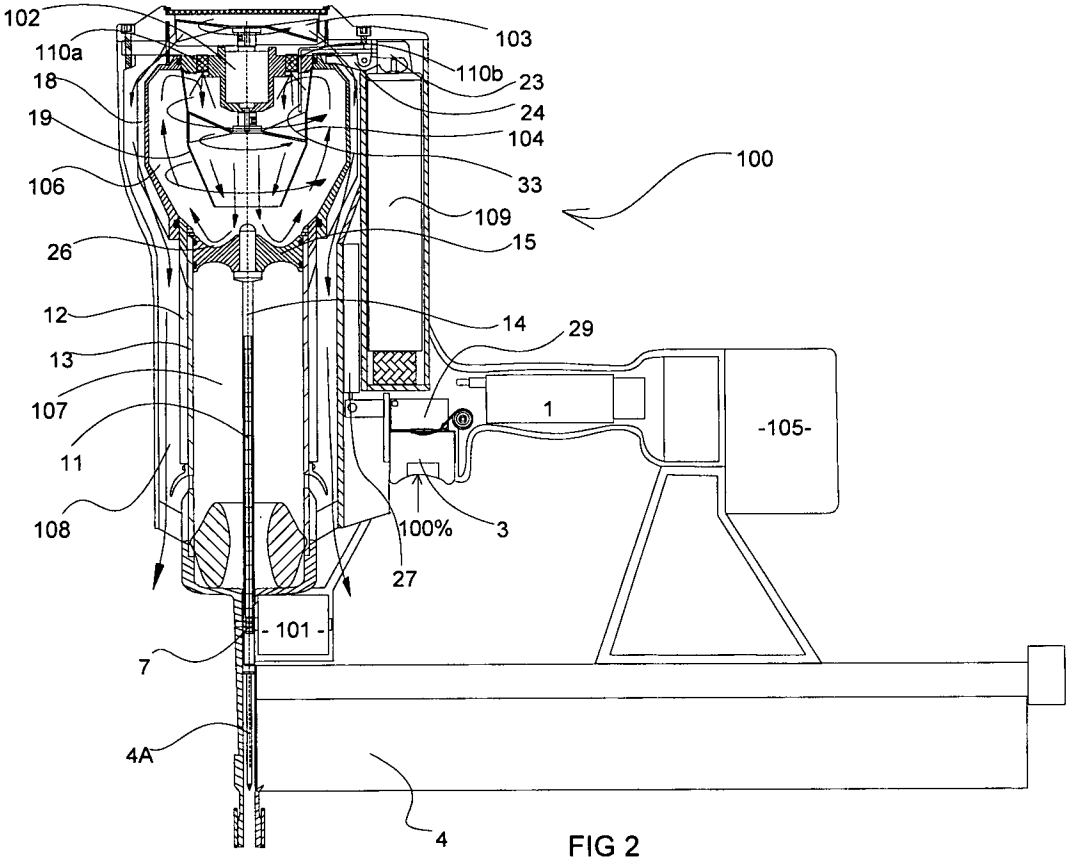
FIG. 2 shows a schematic cross-sectional view of the hand held internal combustion nail fastener tool of FIG. 1 with the driver and piston in a fully retracted position and the air flow paths as air is introduced into the combustion chamber.
Figure 3:
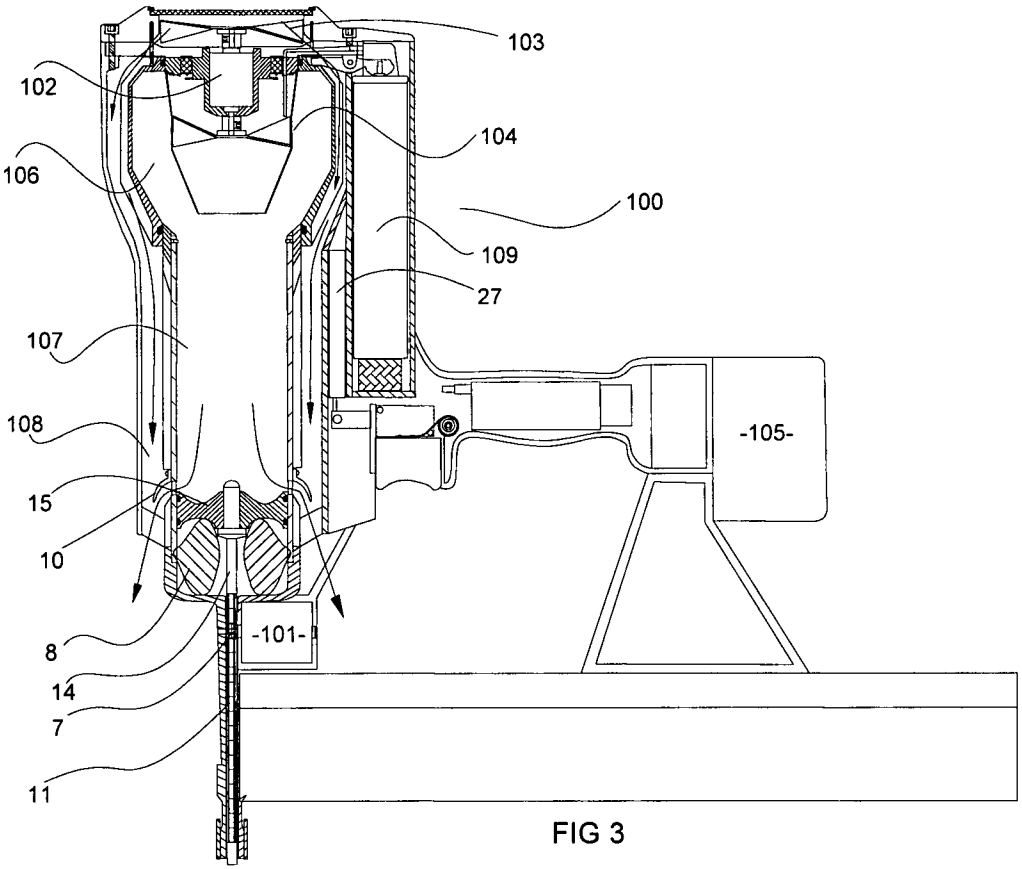
FIG. 3 shows a schematic cross-sectional view of the hand held internal combustion nail fastener tool of FIG. 1 with the driver and piston in a fully extended position where the piston abuts and compresses the bumper as a result of the firing trigger being fully depressed and air/fuel mixture being ignited.

FIGS. 1-10 depict a hand held internal combustion nail fastener tool 100, comprising a driver motor 101, an induction/circulation motor 102, an external induction fan 103, an internal circulation fan 104, a twenty-four volt battery pack 105, a combustion space volume (chamber) 106, a driver cylinder chamber 107 within cylinder 13, an exhaust (cooling) cavity 108, a fuel cell cartridge 109, and igniters 110*a* and 110*b*. The combustion chamber 106 has a frusto-conical shape in the vicinity where it joins with driver cylinder chamber 107.

Figure 4:
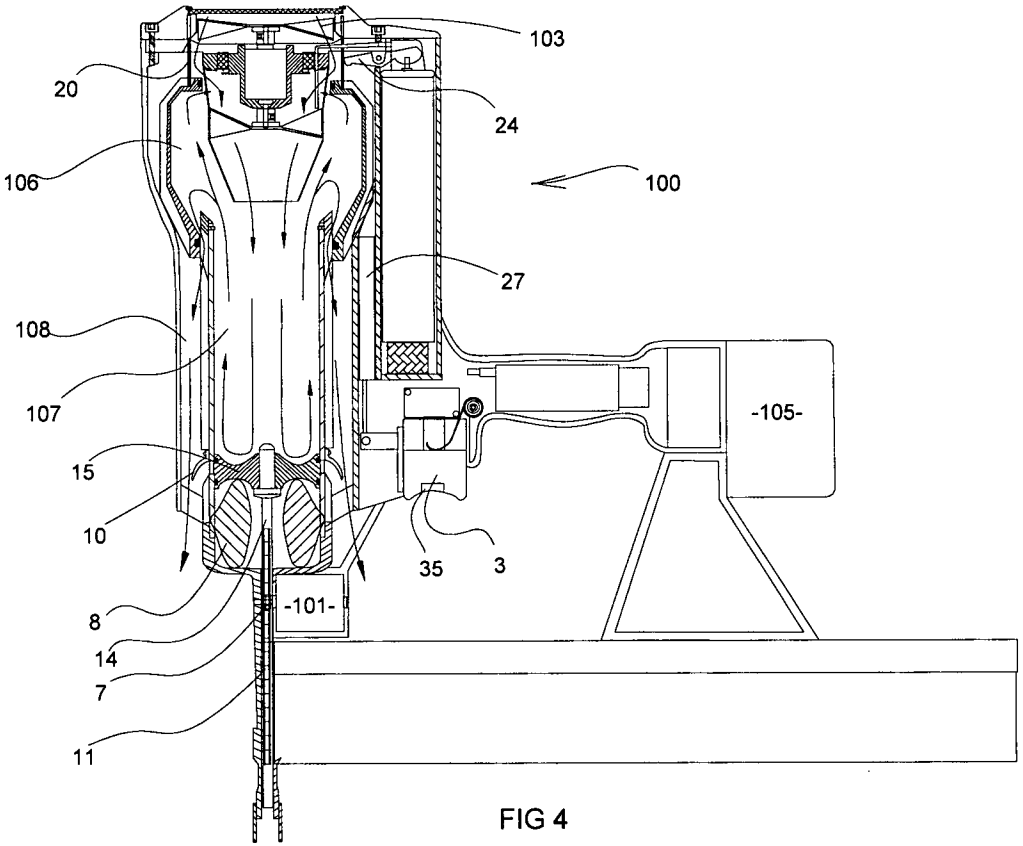
FIG. 4 shows a schematic cross-sectional view of the hand held internal combustion nail fastener tool of FIG. 1 in the mode when a user has touched the trigger, thereby causing external air to be force fed (supercharged) into the combustion and drive cylinder chambers and the piston has been driven to a positioning abuting the bumper and blocking the exhaust port.

The operation of tool 100 will now be described. A user (not shown) holds tool 100 by support handle (pistol grip) 34. Preferably the user's index finger is placed on firing trigger 3. The touch sensor 35 alerts the Electronic Control Module (ECM) 27 that tool 100 is to be operated. ECM 27 actuates the electrical circuit to the induction and circulation fan motor 102 to operate at twelve volts. This results in the external induction fan 103 and internal circulation fan 104 to drive air from external of tool 100 in through air intake filter 21. External air is force fed into the combustion chamber 106 and driver cylinder chamber 107 as charged air. Simultaneously ECM 27 checks the position of drive motor 101, which is in communication with driver 14 and piston 15 via drive motor gear 7 and driver gear rack 11. The drive motor 101 repositions driver 14 and piston 15 so that the underside of piston 15 is resting on bumper 8, see FIG. 4. In this position the piston 15 is blocking the exhaust port 10 and seals chambers 106 and 107. Also at this same point of the tool cycle the combustion chamber housing 17 is in the one hundred percent (100%) open mode in communication with movable tool nose portion 5. As external air is drawn in via fan 103, an air duct 20 prevents the air now under pressure from fan 103 from entering cavity 108, so one hundred percent (100%) of external air is directed into the combustion chamber 106. Upon entering combustion chamber 106, the incoming air is further accelerated by the internal circulation fan 104. As the air passes through fan 104, the air is forced to flow through frusto-conically shaped circulation shroud 25, which further speeds up the air flow. Air is then directed down the centre of driver chamber 107 via shroud 25. At the base of chamber 107 (within cylinder 13), the air flow is split and redirected back up chamber 107 into the combustion chamber 106, via the "toroidally" shaped concave aft surface of piston 15, where the air flow splits and approximately 70% exits chamber 106 via exhaust port 16, flowing into and along cavity 108 and exiting tool 100 via exhaust vent 9. The remaining air flow in chamber 106 (approximately 30%) flows up to the top of the chamber 106 where it rejoins the incoming air flow through a plurality of holes/vents arranged around the base of circulation shroud 25 as seen in FIG. 4.

Figure 5:
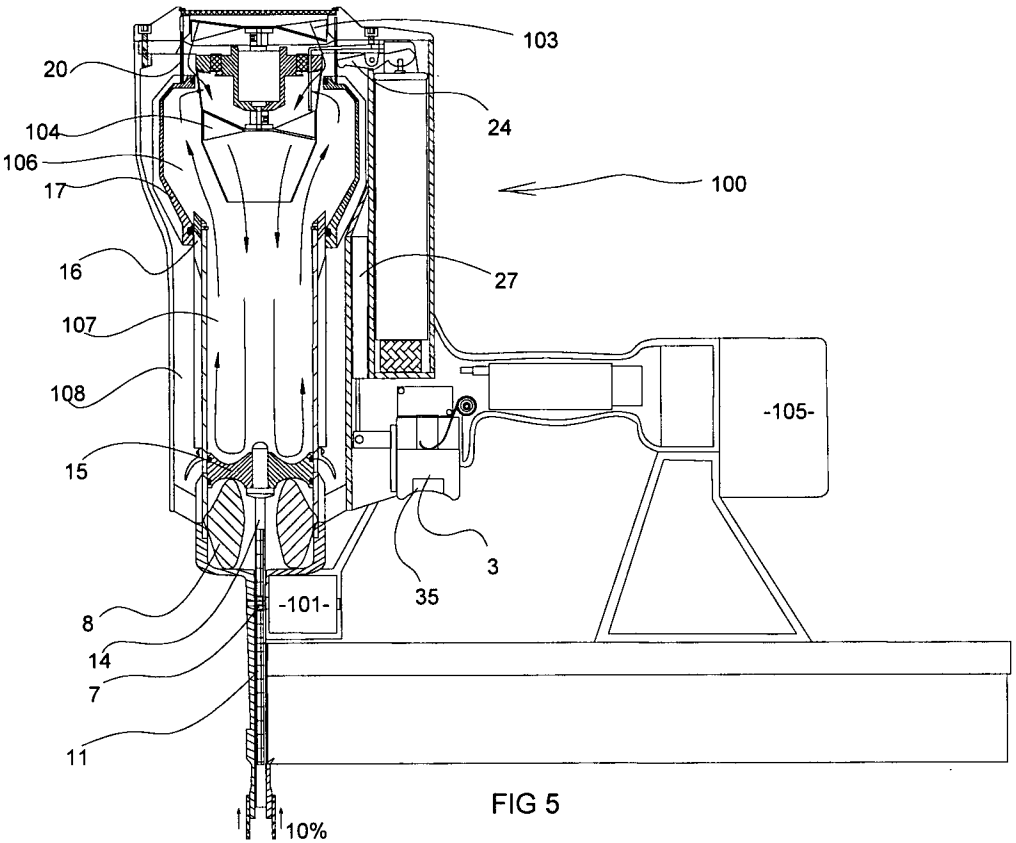
FIG. 5 shows a schematic cross-sectional view of the hand held internal combustion nail fastener tool of FIG. 1 placed against the substrate and ten percent travel of the movable tool nose has occurred.

FIG. 5 depicts tool 100 placed onto a substrate where ten percent (10%) travel of movable tool nose portion 5 has occurred. Tool nose portion 5, which is in communication with housing 17, has caused housing 17 to shut off the exhaust port 16 allowing one hundred percent(100%) of air flow to circulate around chambers 106 and 107. At this same point the ECM 27 has switched motor 102 to twenty-four volts, 200% of the normal manufacturer duty-cycle voltage for motor 102. This causes motor 102 to greatly increase its rotation (rpm) thus increasing the volume and speed of air flow into chambers 106 and 107, as exhaust port 16 is closed the increase in air flow into chambers 106 and 107 causes an increase in air pressure there within. In prior art impulse tools the exhaust port and air inlet would close off simultaneously, however in this embodiment of the invention, after exhaust port 16 closes, the increased rotation of motor 102 continues to introduce "supercharged" air into chambers 106 and 107. This is because the closure of exhaust port 16 is in or near the first ten percent (10%) of travel of housing 17, leaving the inlet side open to receive charged air.

Figure 6:
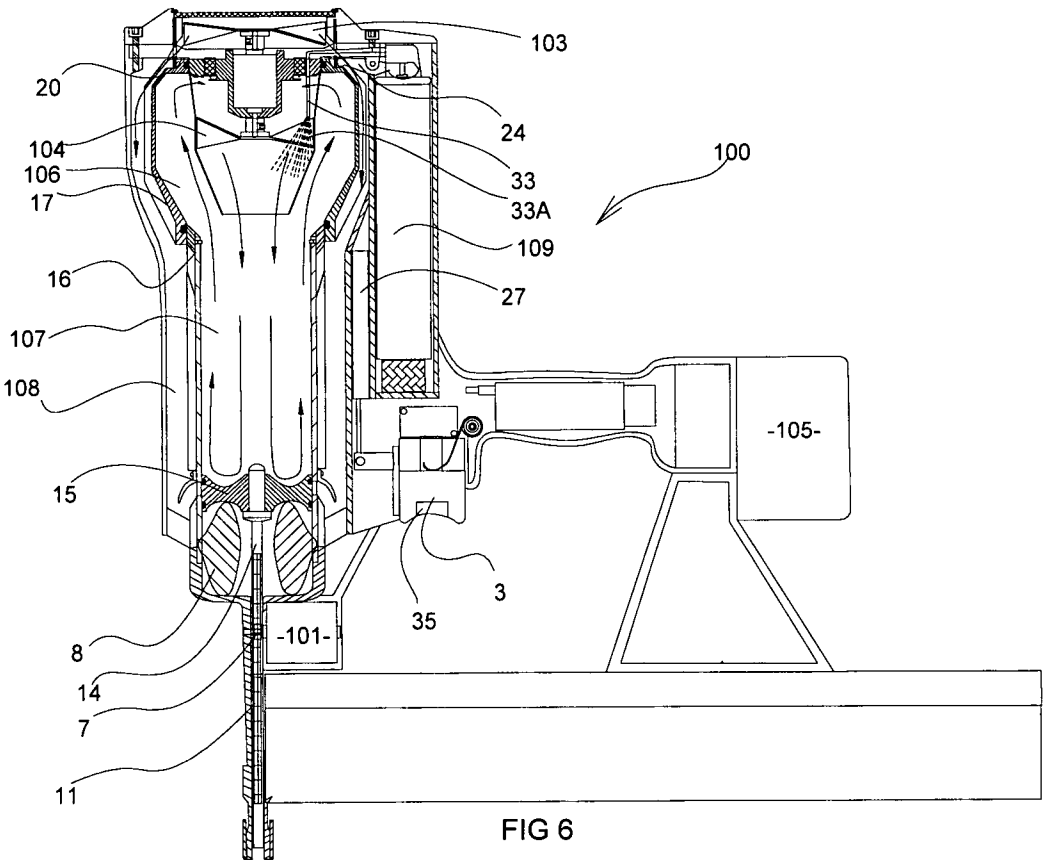
FIG. 6 shows a schematic cross-sectional view of the hand held internal combustion nail fastener tool of FIG. 1 placed against the substrate and one hundred percent travel of the movable tool nose has occurred.

FIG. 6 depicts tool nose 5, in communication with the housing 17, has operated (travelled) at one hundred percent (100%). At this point of the tool cycle, air flow from fan 103 has been redirected into cavity 108 via a plurality of holes/vents now revealed in air ducting shroud 20. During the last say five percent (5%) of travel of chamber housing 17, seals 17A and 17B cause chambers 106 and 107 to be sealed. When chamber housing 17, has operated (travelled) at one hundred percent (100%) and therefore chambers 106 and 107 are sealed, a metered amount of gas from fuel cell 109 via gas regulator valve head 23 and gas regulator valve actuator 24, in communication with 17, has entered chamber 106 through jet 33.

Gas delivery jet 33 is extended into chamber 106 in close proximity to rear of fan 104. As the fuel exits jet 33 the rapidly rotating blades of fan 104 accelerate the vaporization and expansion reaction of the fuel gas as well as rapidly circulating and mixing the air and fuel together in chambers 106 and 107.

Figure 7:
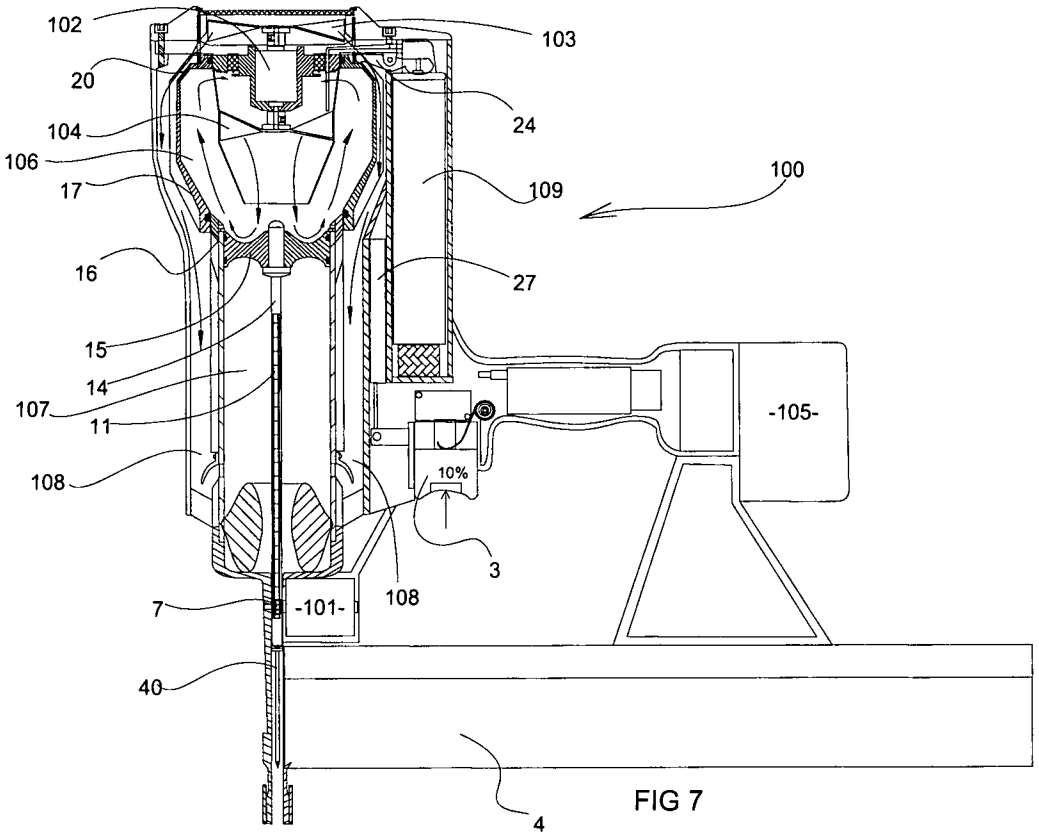
FIG. 7 shows a schematic cross-sectional view of the hand held internal combustion nail fastener tool of FIG. 1 placed against the substrate and the firing trigger been activated about ten percent of its travel.
Figure 8:
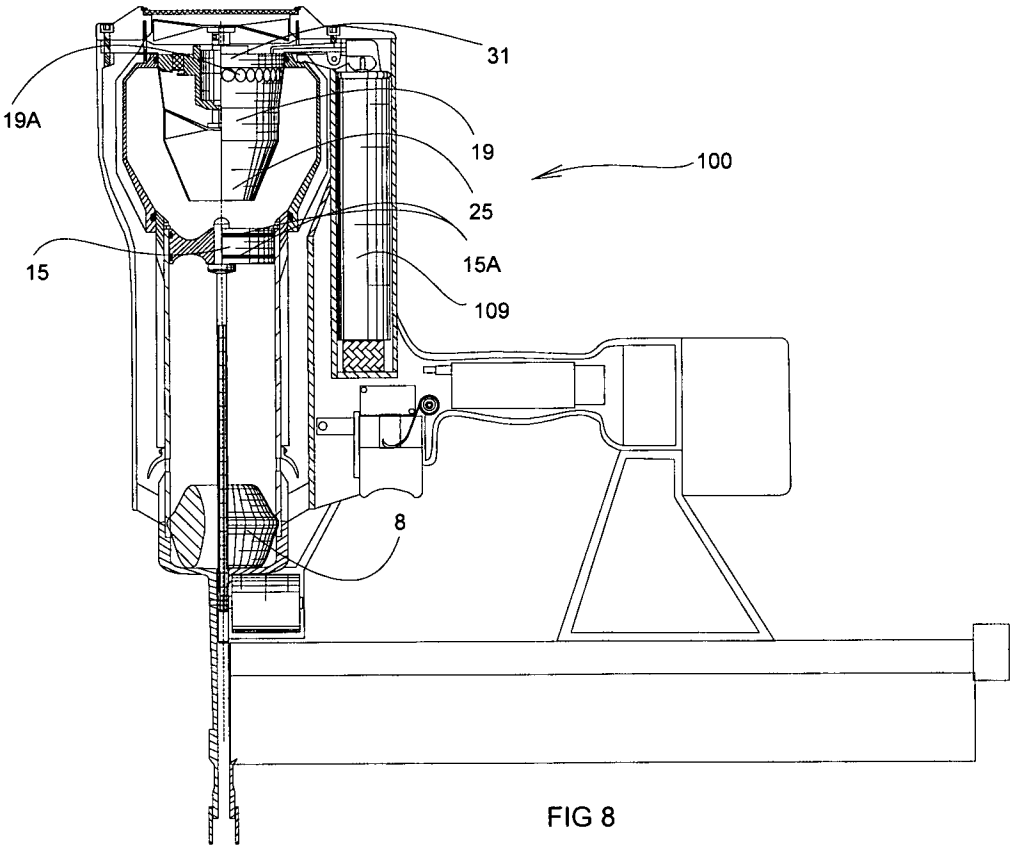
FIG. 8 shows a schematic internal partial cross-sectional view of the hand held internal combustion nail fastener tool of FIG. 1.
Figure 9:
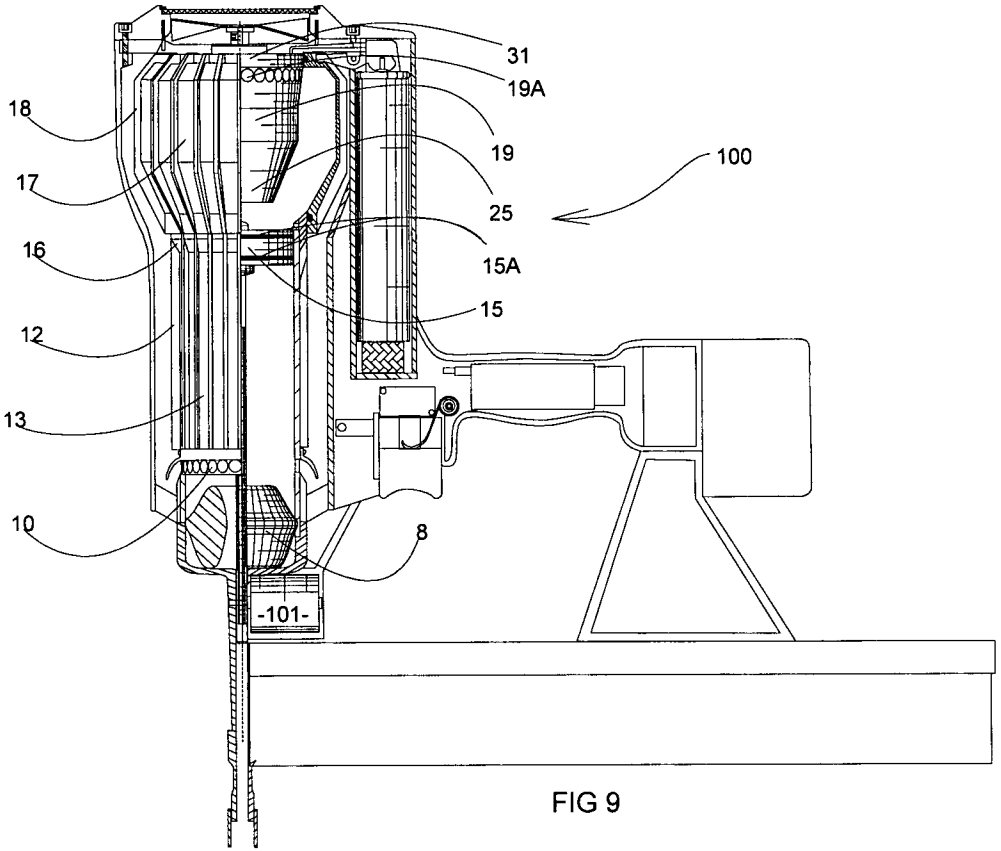
FIG. 9 shows a schematic partial cross-sectional view of the hand held internal combustion nail fastener tool of FIG. 1 with depicting an external portion of the tool.
Figure 10:
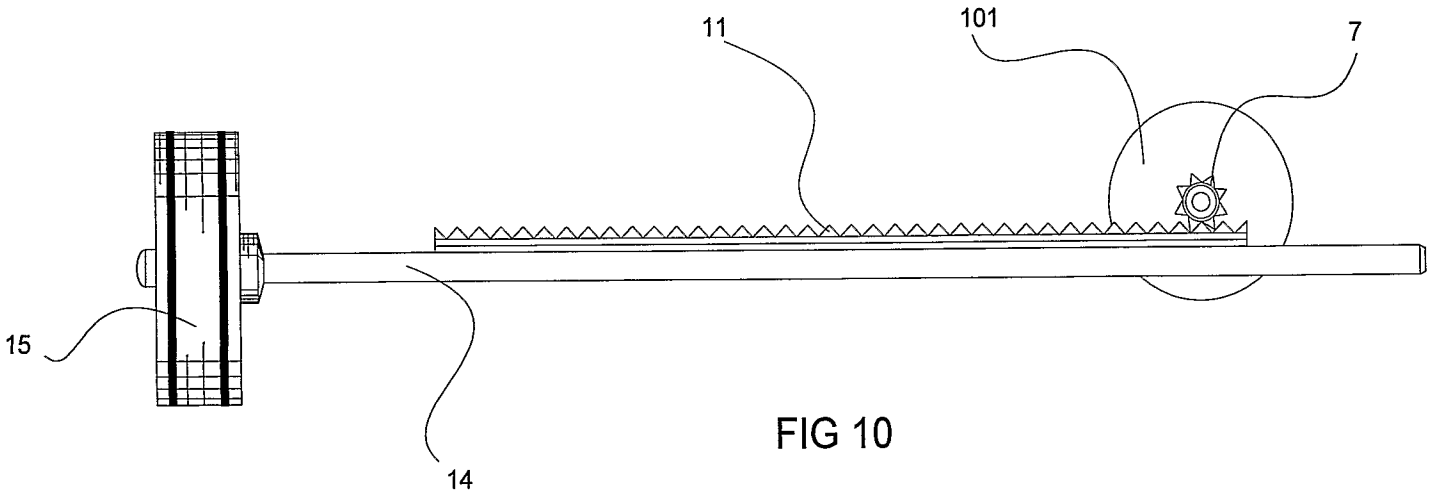
FIG. 10 is shows an enlarged schematic of the drive motor, gear, rack, driver and piston that form the drive assembly.

FIG. 7 also depicts that the firing trigger 3 has been actuated ten percent (10%) of its travel. At this point the ECM 27 in communication with trigger 3 switches electrical circuit on to driver motor 101, causing piston 15 and driver 14 in conjunction with rack 11 and gear 7, to travel one hundred percent (100%) to the top of driver cylinder 13. As chamber 106 is sealed all the air mass in chamber 107 is compressed in to chamber 106, creating a pressure greater than ambient (pressure difference). Also, as the driver assembly 14 and piston 15 achieve one hundred percent (100%) of travel up to the top of cylinder 13, a nail 40 has been placed into the fixed tool nose 6 from fastener magazine 4. Air and fuel now contained in chamber 106 circulates rapidly, shroud 25 directs the fuel/air mixture across the igniters 110*a* and 110*b*, by means of vents/holes (not shown) at the base of shroud 25.

FIG. 4 depicts that firing trigger 3 has operated 100% of its travel. ECM 27 switches circuit on to high tension ignition coil 1, thereby operating same very rapidly, at approximately twenty-five to fifty applications. The resulting pulses of high voltage created by the ignition coil 1 are in communication with igniters 110*a* and 110*b*. The resulting multiple high-tension sparks from igniters 110*a* and 110*b* ignite the fuel/air mixture in combustion chamber 106 simultaneously. ECM 27 switches driver motor 101 to a separate electrical circuit converting driver motor 101 to a generator. As the fuel/air mixture ignites in chamber 106, a rapid rise in pressure occurs forcing the driver assembly 14 and piston 15 down cylinder 13 ejecting nail 40 into the substrate (or work piece). As the driver assembly 14 and piston 15 progress down the cylinder 13, motor 101 now acting as a generator is in communication with driver assembly 14, via rack 11 and gear 7. The resulting charge is sent back into the battery pack 105, increasing battery/tool cycles between charges. As the driver assembly (driver 14 and piston 15) reach 90% of travel, the underside of piston 15 comes into contact with bumper shock absorber 8, which reduces the kinetic energy of driver 14 and piston 15, bringing them to a steady controlled stop in cylinder 13. At this stage of the tool/combustion cycle the exhaust ports 10 configured in plurality at the base of cylinder 13, are uncovered by piston 15. The exhaust gases in chambers 106 and 107 escape/evacuate through exhaust ports 10, reducing the gas pressure in chambers 106 and 107 to a partial vacuum (lower pressure) than ambient. The stored energy in bumper 8 then repels the driver assembly (driver 14 and piston 15) approximately thirty percent (30%) back up bore 13. ECM 27 then switches fan motor 102 back to normal running mode at 12V. Simultaneously ECM 27 in communication with driver motor 101 checks the position of the driver assembly (driver 14 and piston 15) and adjusts as required, at the bottom of the bore 13 with underside of piston 15 resting on bumper 8 also "closing off" the exhaust ports 10.

Tool 101 is then raised off the substrate allowing movable tool nose portion 5 to extend. Tool nose portion 5 in communication with housing 17 slides forward, allowing air to circulate around 106 and 107 and exit through exhaust ports 16. The firing trigger 3 is then released resetting the ECM 27 back to the start cycle status.

A hand-held power tool as described in the abovementioned embodiment overcomes the disadvantages of the prior art prior by achieving:

- Higher output energy
- more consistent energy production
- Reduced exhaust emissions
- Reduction in tool overall size for a given energy output
- Increases the range of "impulse tool" capability into 4 inch (100 mm) nails and concrete pins The above mentioned embodiment of the present invention overcomes the disadvantages and difficulties of the prior art by:

- Reconfiguring the combustion cycle/process.
- Supercharging the induction process.
- Improving the working fluid air/fuel mixture, mass by adding a secondary stage of compression prior to ignition.
- Improving the fuel atomization process.
- Improving the ignition process.
- Improving the combustion chamber dynamics.
- Improving the gas flow across the driver piston surface.
- Redefine the gas flow and mixing process within the combustion chamber.
- Improving the ignition and flame front progress.

In a modification of the first embodiment not shown, motor 101 is replaced by a coil spring assembly positioned inside cylinder 13 acing upon the underside of driver piston 15. A locking mechanism in mechanical communication with driver 14 will also be necessary to achieve driver piston and driver assembly return when chambers 106 and 107 are under pressure resulting in a charged air system.

Figure 11:
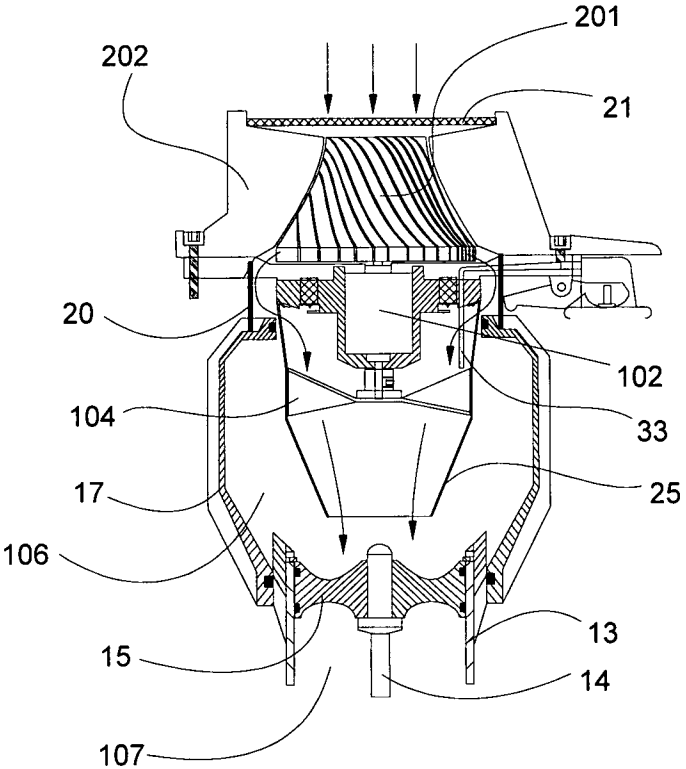
FIG. 11 shows a schematic cross-sectional view of a hand held internal combustion nail fastener tool in accordance with a second embodiment of the present invention.

In a second embodiment, FIG. 11 shows alternative methods of pre-charging or super-charging an internal gas combustion nail/fastening tool 100 of the first embodiment. In this embodiment turbine/fan (compressor) 201 replaces conventional fan blade 103. Fan motor 102 drives both internal circulation fan 104 and centrifugal turbine/fan 201. Turbine/fan 201 is capable of delivering much higher air pressure than conventional fan blade 103. With this type of super-charging arrangement utilizing turbine/fan 201, it is necessary to extend the rear tool housing 202 to provide appropriate ducting.

Figure 12:
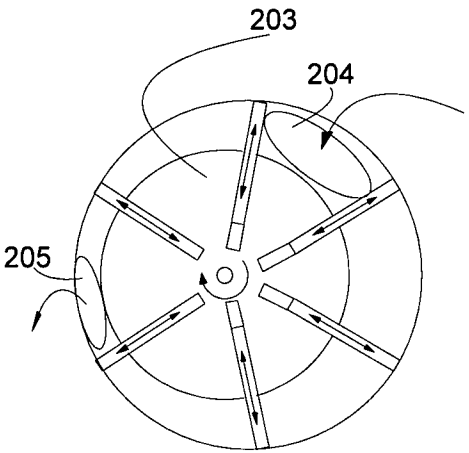
FIG. 12 shows a schematic internal view of a positive displacement rotary vane air pump that may replace turbine/fan utilised in the tool shown in FIG. 11.

FIG. 12 shows an arrangement of a positive displacement rotary vane air pump (compressor) 203 with inlet port 204 and outlet port 205. Rotary vane air pump 203 device can replace turbine/fan 201 of the second embodiment and achieve even higher air pressure delivery to tool 100 of the first embodiment.

It should be understood that although various air pump (compressor) mechanisms such as external induction fan 103, turbine/fan 201 and rotary vane air pump 203 have been described in the abovementioned embodiments for the supercharging of tool 100, it is not limited to these particular mechanisms, and other air pump mechanisms may be utilised.

Where higher efficiency pump mechanisms, such as turbine/fan 201 or rotary vane air pump 203 are used in a hand held internal combustion nail fastener tool 100 utilizing a super-charging combustion process as described, it is possible to dispense with driver motor 101, drive motor gear 7 and driver gear rack 11. To combat the charged air effect in combustion chamber 106 it would be necessary to incorporate a driver piston locking holding mechanism (not shown), to hold the driver mechanism 14 and 15 in place at the top of the driver cylinder 13 until ignition has taken place. As combustion pressure rises in combustion chamber 106, typically in excess of 10 bar, the gas combustion pressure acting upon driver piston 15 will overcome the driver assembly locking mechanism (not shown) and eject a nail at high velocity from tool 100. The driver assembly locking mechanism may be configured so that the driver assembly 14 and 15 is held at the top of the cylinder 13 until a pressure of typically say 1.5 bar exists in combustion chamber 106.

The terms "comprising" and "including" (and their grammatical variations) as used herein are used in inclusive sense and not in the exclusive sense of "consisting only of".

The invention claimed is:

1. A hand-held power tool, the operational power of which is provided by a gas combustion mechanism, said gas combustion mechanism comprising a first combustion chamber, a second chamber within a driving cylinder having an aft end and a fore end, said first combustion chamber in fluid communication with said second chamber via said aft end, at least one fan assembly, a driver assembly having a piston and driver movable within said driving cylinder between said aft end and said fore end, and a drive motor operably connected to said driver assembly, wherein in use, whilst said piston is at or near said fore end of said driving cylinder, said fan assembly introduces air into said first combustion chamber and said second chamber thereby at least partially pressuring the air there within, fuel gas is introduced into said combustion chamber from a fuel supply port, the air and fuel gas being mixed to form an air/fuel gas mixture therein, said drive motor operably moves said piston to a position at or near said aft end thereby compressing said air/fuel gas mixture within said first combustion chamber so that said air/fuel mixture is ignited within the combustion chamber to impart motion onto said piston and to facilitate the operation of the tool.

2. A hand-held power tool as claimed in claim 1, wherein said fan assembly has an external induction fan for introducing air into said first combustion chamber.

3. A hand-held power tool as claimed in claim 1, wherein said fan assembly has an internal circulation fan disposed within said first combustion chamber.

4. A hand-held power tool as claimed in claim 3, wherein said internal circulation fan is shrouded by a shroud having a free end portion that is frusto-conical in shape.

5. A hand-held power tool as claimed in claim 1, wherein said first combustion chamber is frusto-conically shaped in a region near where it adjoins said driving cylinder.

6. A hand-held power tool as claimed in claim 1, wherein said piston has an aft surface having a concave toroidal shape therein for redirecting air centrally forced thereon by said fan assembly.

7. A hand-held power tool as claimed in claim 1, wherein a separate exhaust cavity is at least partially disposed externally around said first combustion chamber and said driving cylinder, said exhaust cavity having an exhaust vent located near the fore end of said driving cylinder.

8. A hand-held power tool as claimed in claim 7, wherein a plurality of apertures interconnect said exhaust cavity with said first combustion chamber, and an air ducting shroud disposed near said apertures prevents air from passing there through when air is being introduced into said combustion chamber by said fan assembly.

9. A hand-held power tool as claimed in claim 7, wherein at least one exhaust port in communication with said exhaust cavity is located in said driving cylinder near its aft end, said exhaust port being closed by said piston when said piston has travelled to said aft end of said driving cylinder.

10. A hand-held power tool as claimed in claim 9, wherein said exhaust port closes to allow supercharged air to be introduced into said combustion chamber.

11. A hand-held power tool as claimed in claim 1, wherein said tool further comprises a movable tool nose assembly and a trigger assembly both operably connected to an electronic control module for the control and actuation of the fan assembly, drive motor and fuel supply port.

12. A hand-held power tool as claimed in claim 1, wherein said fan assembly and said drive motor are operably powered by a battery.

13. A hand-held power tool as claimed in claim 12, wherein said drive motor is adapted to act as a generator operably connected to an electronic control module for charging of said battery.

14. A hand-held power tool as claimed in claim 1, wherein said air/fuel mixture is ignited by an ignition process initiated by multiple high tension sparks.

15. A hand-held power tool as claimed in claim 14, wherein said multiple high tension sparks are emitted from a plurality of igniters.

16. A hand held power tool as in claim 1, wherein the air is introduced into the combustion chamber and driver by a turbine/fan compressor.

17. A hand held power tool as in claim 1, wherein the air is introduced into the combustion chamber and driver by a positive displacement rotary vane compressor.

18. A hand held power tool as in claim 1, wherein the air introduced into the combustion chamber and driver is supercharged and a holding mechanism holds the driver assembly against super-charged air until ignition takes place.

19. A hand held power tool as in claim 1 wherein an increase in tool energy is a result of supercharging.

20. A hand-held power tool, the operational power of which is provided by a gas combustion mechanism, said gas combustion mechanism comprising a first combustion chamber, and a second chamber within a driving cylinder having an aft end and a fore end, said first combustion chamber in fluid communication with said second chamber via said aft end, and a driver assembly having a piston and driver movable within said driving cylinder between said aft end and said fore end, and a drive motor operably connected to said driver assembly, wherein in use the volume of said first combustion chamber and said second chamber is fluidally pressurized in first and second stages, where said first stage comprises introducing supercharged air into said first combustion chamber and said second chamber via a fan whilst said piston is at or near said fore end of said driving cylinder and subsequently a fuel gas is introduced into said combustion chamber from a fuel supply port, the air and fuel gas being mixed to form an air/fuel gas mixture therein, and in said second stage said drive motor moves said piston to said aft end thereby compressing said fuel/gas mixture in said first combustion chamber so that said air/fuel mixture is ignited within the combustion chamber to impart motion onto said piston and to facilitate the operation of the tool.

* * * * *